US007971647B2

(12) United States Patent
Mayfield et al.

(10) Patent No.: US 7,971,647 B2
(45) Date of Patent: Jul. 5, 2011

(54) APPARATUS AND METHOD FOR RAISING A FLUID IN A WELL

(75) Inventors: Windel O. Mayfield, Brownwood, TX (US); Robert L. Moore, Weatherford, TX (US)

(73) Assignee: Paal, L.L.C., Oklahoma City, OK (US)

( * ) Notice: Subject to any disclaimer, the term of this patent is extended or adjusted under 35 U.S.C. 154(b) by 170 days.

(21) Appl. No.: 12/124,535

(22) Filed: May 21, 2008

(65) Prior Publication Data

US 2009/0288837 A1 Nov. 26, 2009

(51) Int. Cl.
*E21B 43/00* (2006.01)

(52) U.S. Cl. ..... 166/369

(58) Field of Classification Search ..... 166/105, 166/369, 382

See application file for complete search history.

(56) References Cited

U.S. PATENT DOCUMENTS

| | | | | |
|---|---|---|---|---|
| 1,790,450 | A | 1/1931 | Torrance | |
| 2,674,951 | A | 4/1954 | Zaba | |
| 2,688,928 | A | 9/1954 | Vincent et al. | |
| 2,830,540 | A | 4/1958 | Vincent | |
| 2,850,339 | A | 9/1958 | Vincent | |
| 3,147,808 | A | 9/1964 | McCarvell et al. | |
| 3,150,596 | A | 9/1964 | Knox | |
| 3,273,504 | A | 9/1966 | Lyles | |
| 3,329,211 | A | 7/1967 | Roach | |
| 3,556,222 | A * | 1/1971 | Lumpkin et al. | 166/369 |
| 3,968,839 | A * | 7/1976 | Swihart, Sr. | 166/250.07 |
| 4,070,134 | A | 1/1978 | Gramling | |
| 4,363,606 | A | 12/1982 | Kilgore | |
| 4,531,891 | A | 7/1985 | Coles | |
| 4,696,624 | A | 9/1987 | Bass et al. | |
| 4,712,981 | A | 12/1987 | Gramling | |
| 4,789,031 | A * | 12/1988 | Walker | 166/369 |
| 4,813,485 | A | 3/1989 | Coyle | |
| 4,923,727 | A | 5/1990 | Maruyama et al. | |
| 5,086,839 | A | 2/1992 | Setterberg et al. | |
| 5,188,182 | A | 2/1993 | Echols, III et al. | |
| 5,253,713 | A | 10/1993 | Gregg et al. | |
| 5,309,998 | A * | 5/1994 | Rivas et al. | 166/265 |
| 5,411,098 | A * | 5/1995 | Schmidt et al. | 166/369 |
| 5,417,281 | A * | 5/1995 | Wood et al. | 166/68 |
| 5,427,504 | A | 6/1995 | Dinning et al. | |
| 5,743,336 | A * | 4/1998 | Davis | 166/380 |
| 5,775,429 | A | 7/1998 | Arizmendi et al. | |
| 6,089,322 | A * | 7/2000 | Kelley et al. | 166/370 |
| 6,173,768 | B1 | 1/2001 | Watson | |

(Continued)

OTHER PUBLICATIONS

PCT Search Report, PAAL, L.L.C.

*Primary Examiner* — David J Bagnell
*Assistant Examiner* — Blake Michener
(74) *Attorney, Agent, or Firm* — Fellers, Snider, Blankenship, Bailey & Tippens, P.C.; Dennis D. Brown

(57) ABSTRACT

An apparatus, and a method which uses the apparatus, for raising a fluid from a lower region to a higher region of an at least partially cased well. The apparatus includes: a tubing string; a contacting structure at the upper end of the tubing string for engaging a stop structure in the well casing such that the tubing string is held in suspension; an exterior sealing element for sealing against the casing wall; and an internal check valve.

11 Claims, 4 Drawing Sheets

U.S. PATENT DOCUMENTS

| | | | | |
|---|---|---|---|---|
| 6,200,103 | B1 | 3/2001 | Bender | |
| 6,502,639 | B2 | 1/2003 | Leniek, Sr. | |
| 6,554,580 | B1 | 4/2003 | Mayfield et al. | |
| 6,634,426 | B2 | 10/2003 | McCoy et al. | |
| 6,637,510 | B2 | 10/2003 | Lee | |
| 6,907,926 | B2 | 6/2005 | Bosley | |
| 6,971,856 | B1 | 12/2005 | Mayfield et al. | |
| 7,111,682 | B2 * | 9/2006 | Blaisdell | 166/264 |
| 7,337,854 | B2 | 3/2008 | Horn et al. | |
| 7,556,097 | B2 * | 7/2009 | Heller et al. | 166/264 |
| 2008/0011487 | A1 * | 1/2008 | Bertane et al. | 166/369 |
| 2008/0164033 | A1 * | 7/2008 | Brink | 166/370 |
| 2008/0314581 | A1 * | 12/2008 | Brown | 166/105 |

* cited by examiner

APPARATUS AND METHOD FOR RAISING A FLUID IN A WELL

FIELD OF THE INVENTION

The present invention relates to an apparatus and a method for raising a fluid within a well to a higher elevation. The present invention also relates to an apparatus and method for producing gas and liquid from the well by raising a fluid to a higher elevation and then removing the fluid from the well.

BACKGROUND OF THE INVENTION

In some wells, due to relatively low formation gas pressures and/or other conditions, oil, water, and/or other fluids tend to accumulate at some level within the well casing rather than flowing naturally to the surface. Although various types of systems have been used for lifting and removing fluids from such wells, plungers offer particular advantages. By lifting and removing fluid from the well, a plunger can operate to increase gas production by reducing the amount of fluid pressure head acting on the formation. Alternatively, swabbing systems and rod pumps can be used in some cases to achieve similar results, but generally are not as cost effective.

Various types of plunger devices are known in the art. By way of example, one common type of plunger comprises: an elongate housing assembly; one or more external sealing devices which can be actuated to sealingly contact the interior wall of the well casing; a flow passage extending through the housing assembly; and a valve for opening and closing the flow passage.

When using a well plunger, a lubricator assembly is typically installed above ground at the wellhead for receiving and retaining the plunger between production cycles. At the beginning of a production cycle, the plunger is dropped from the lubricator assembly with the plunger valve in open position. The fluid in the well casing or tubular is thus allowed to flow through the interior flow passage so that the plunger will drop through the fluid to a stop structure installed at a desired downhole position.

The plunger will typically be configured such that, upon striking the downhole stop structure, the plunger valve will automatically close and the external seal(s) will be urged into contact with the interior wall of the casing. With the casing sealed in this manner, the pressure beneath the plunger will eventually increase to the point that the plunger will begin to rise, thus lifting the column of fluid on top of the plunger toward the surface and into an overhead production line.

In many cases, because of any one of or a combination of factors such as, for example, a further deterioration in well gas pressure, damage to the well casing, the presence of obstructions within the casing, the use of a deviated or horizontal casing having non-vertical and/or non-linear sections, the presence of multiple producing zones, the absence of casing extending entirely to the bottom of the well (e.g., in an open hole completion), and/or other formation or casing conditions, plungers and other devices either cannot be used or are of limited effectiveness for removing fluid from the well.

One example of a situation where a plunger can no longer be used is where the formation conditions have become such that fluid is now standing at a level below or at some intermediate point within a perforated section of the casing. Consequently, if a plunger were dropped into the well casing below the liquid level, and even assuming that the gas pressure in the well would otherwise be sufficient to lift the plunger, the presence of casing perforations at an elevation above the plunger would prevent the plunger from operating to raise a column of fluid to the surface.

A similar situation can also arise in the case of well casings having a plurality of perforated sections which are spaced apart vertically in different formation zones. In such cases, plungers are ineffective for removing liquid from the well if the liquid level is standing in or below one or more of the upper perforated sections. Moreover, even in cases where a small amount of fluid can be removed from a point above the top perforated zone, the pressure head conditions acting on the lower zone(s) can be such that the production from the lower zone(s) becomes blocked or is at least compromised.

Another situation which can prevent or at least create problems for the use of plungers, swabbing devices, rod pumps, and similar devices arises where the casing becomes damaged at a location above the perforated section(s). If the casing is damaged in such a way as to form one or more holes in the casing, then the operation of a plunger can be prevented or compromised in the same manner as discussed above. Alternatively, or in addition, the formation of jagged or rough areas as a result of casing damage can block the passage of a plunger or other device, or can damage or destroy the device during operation.

Another situation where the use of a plunger or similar device can be prevented or compromised is where an obstruction is present. Examples of common obstructions include, but are not limited to, (a) permanent packers and other tools which, for whatever reason, are set in the casing at problematic locations above the perforated zone(s), (b) smaller diameter liners which have been installed in the casing for repair or other reasons, (c) tapered or stepped casing sections which produce changes in the interior diameter, and (d) curved or other non-linear sections of casing of the type employed, for example, in deviated or horizontal wells.

Consequently, a need exists for an apparatus and method which will operate in situations and scenarios of the type described above to raise fluid in a well to a higher cased elevation to allow the fluid to be reached and removed by a plunger, swabbing device, rod pump, or similar device. Such apparatus and method will preferably be effective, for example, for raising a fluid (a) from a depth below a liquid level in the well casing, (b) from a depth within or below one or more perforated casing sections, (c) from a depth or location beyond a casing obstruction and (d) from a non-cased terminal portion of a well (such as, e.g., in an open hole completion). In addition, a need exists for an apparatus and system of this type which, if desired or necessary, can be conveniently installed in the well casing without requiring that tubing rigs or similar systems and equipment be transported to and used at the well site.

SUMMARY OF THE INVENTION

The present invention satisfies the needs and alleviates the problems discussed above. The present invention provides and uses a novel tubing assembly and system which, although installable using tubing or other systems, can be conveniently set and installed in, or retrieved from, the well casing by wire line. Examples of common wire line systems include, but are not limited to, swab rigs, slick line systems, workover rigs, and electrical lines.

In one aspect, there is provided an apparatus for raising a fluid from a lower region of a well to a second region of the well above the lower region wherein a casing is present in said well in at least the second region. The apparatus comprises: (a) a tubing string having one or more openings in a lower portion thereof for receiving the fluid from the lower region of the well; (b) a contacting structure positioned for engaging a stop structure in the casing such that the tubing string will be held in suspension; (c) at least one exterior sealing element positioned above the one or more openings for sealing between the apparatus and an interior wall of the casing; and (d) an internal check valve positioned above the one or more openings.

In another aspect, there is provided an apparatus for raising a fluid in a well from a lower well region to a second well region above the lower well region. The apparatus comprises: (a) a well casing present in at least the second well region; (b) a stop structure positioned in the well casing at a lower end of the second well region, the stop structure having an opening extending therethrough, and (c) a tubing assembly extending through the opening of the stop structure. The tubing assembly comprises a tubing string having a lower portion positioned in the lower well region. The lower portion of the tubing string has one or more openings for receiving the fluid from the lower well region. The tubing assembly also comprises a contacting structure for contacting the stop structure in a manner effective for holding the tubing string in suspension in the well. In addition, the tubing assembly further comprises at least one exterior sealing element positioned above the one or more openings for sealing between the tubing assembly and an interior wall of the well casing.

In another aspect, there is provided a method of producing fluid from a well having a lower well region. The well has a casing therein comprising at least a perforated casing section located above the lower well region and an upper casing section which is located above the perforated casing section and which extends to a wellhead. The method comprises the step of installing a tubing assembly in the well wherein: (a) the tubing assembly comprises a tubing string which is inserted downwardly into the well through a stop structure secured in the casing above the perforated casing section; (b) the tubing assembly further comprises a contacting structure which contacts the stop structure such that the tubing string is held suspended in the well; (c) the tubing string has a lower portion which is positioned in the lower well region, the lower portion of the tubing string having one or more openings for receiving fluid from the lower well region such that the fluid travels upwardly through the tubing assembly from the lower well region into a lower portion of the upper casing section; and (d) the tubing assembly also comprises at least one exterior seal which is positioned above the one or more openings and which seals between the tubing assembly and an interior wall of the casing to substantially prevent the fluid from flowing through the casing outside of the tubing assembly past the exterior seal. The method also comprises the step of raising the fluid from the lower portion of the upper casing section to the wellhead.

In another aspect, there is provided a method of producing fluid from a well having a lower region. The well has a casing therein comprising at least a casing obstruction located above the lower well region and an upper casing section which is located above the casing obstruction and which extends to the wellhead. The method comprises the step of installing a tubing assembly in the well wherein: (a) the tubing assembly comprises a tubing string which is inserted downwardly into the well through a stop structure secured in the casing above the casing obstruction; (b) the tubing assembly further comprises a contacting structure which contacts the stop structure such that the tubing string is held suspended in the well; (c) the tubing string has a lower portion which is positioned in the lower well region, the lower portion of the tubing string having one or more openings for receiving fluid from the lower well region such that the fluid travels upwardly through the tubing assembly from the lower well region into a lower portion of the upper casing section; and (d) the tubing assembly also comprises at least one exterior seal which is positioned above the one or more openings and which seals between the tubing assembly and an interior wall of the casing to substantially prevent the fluid from flowing through the casing outside of the tubing assembly past the exterior seal. In addition, the method also comprises the step of raising the fluid from the lower portion of the upper casing section to the wellhead.

In another aspect, there is provided a method of producing fluid from a well having a lower well region and an upper section above the lower well region. The upper section has a well casing extending therethrough and also extends to a wellhead. The lower region has no casing therein. The method comprises the step of installing a tubing assembly in the well wherein: (a) the tubing assembly comprises a tubing string which is inserted downwardly into the well through a stop structure secured in the well casing above the lower well region; (b) the tubing assembly further comprises a contacting structure which contacts the stop structure such that the tubing string is held suspended in the well; (c) the tubing string has a lower portion which is positioned in the lower well region, the lower portion of the tubing string having one or more openings for receiving the fluid from the lower well region such that the fluid travels upwardly through the tubing assembly from the lower well region into a lower portion of the upper section; and (d) the tubing assembly also comprises at least one exterior seal which is positioned above the one or more openings and which seals between the tubing assembly and an interior wall of the well casing to substantially prevent the fluid from flowing through the well casing outside of the tubing assembly past the exterior seal. In addition, the method also comprises the step of raising the fluid from the lower portion of the upper section to the wellhead.

Further objects, features, and advantages of the present invention will be apparent to those of ordinary skill in the art upon examining the accompanying drawings and upon reading the following detailed description of the preferred embodiments.

DETAILED DESCRIPTION OF THE PREFERRED EMBODIMENTS

Figure 1:
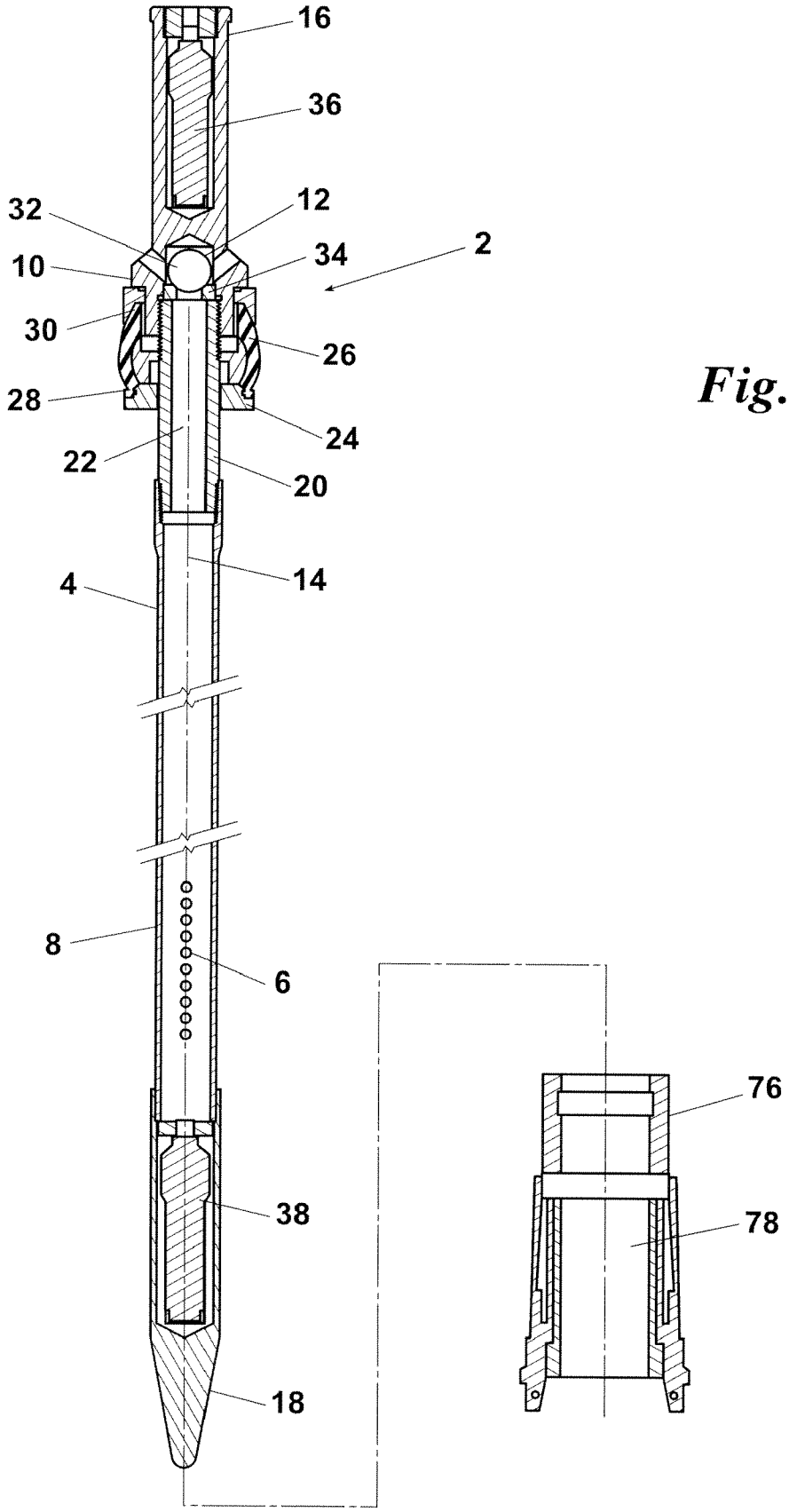
FIG. 1 is a cutaway elevational view of an embodiment 2 of the tubing assembly provided by the present invention.

An embodiment 2 of the inventive tubing assembly for raising a fluid in a well is shown in FIG. 1. The inventive tubing assembly 2 preferably comprises: a tubing string 4; one or more (preferably a plurality) of fluid intake openings 6 provided in a lower end portion 8 of the tubing string 4; a sealing element assembly 10 at the upper end of the tubing string 4; an internal check valve 12 provided in the internal flow passage 14 of the tubing assembly 2 at a location above the fluid intake openings 6; and a fishing neck 16 attached on the upper end of the tubing assembly 2 above the sealing element assembly 10. The tubing string 4 preferably also has a tapered lower end 18 for threading the tubing string 4 through a stop structure 76 as discussed hereinbelow. The tubing string 4 can be as short or as long as needed for any given well. It is presently contemplated that for most applications, the tubing string 4 will typically be in the range of from about 20 to about 1000+ feet in length.

The sealing element used in the inventive tubing assembly 2 can generally be any type of sealing element which, when engaged, will be effective for substantially preventing flow from occurring outside of the inventive tubing assembly 2. The sealing element assembly 10 used in inventive tubing assembly 2 preferably comprises: an assembly body 20 which is threadedly or otherwise attached to the upper end of the tubing string 4 and has an internal flow passage 22 extending therethrough; a landing collar or other contacting structure 24 slideably mounted on the exterior of the assembly body 20 for reciprocating movement; and a sealing cup 26. The sealing cup 26 surrounds the assembly body 20 and is attached at its lower end 28 to the landing collar 24. The upper end 30 of the sealing cup 26 is secured in a fixed position such that the upward movement of the landing collar 24 on the assembly body 20 will compress the sealing cup 26. When compressed by the landing collar 24, the sealing cup 26 will flex outwardly for sealing engagement with the interior wall of a well casing.

When the inventive tubing assembly 2 is installed downhole in a well casing, the weight of the tubing string 4 and the other components of the tubing assembly 2 will operate to compress the sealing cup 26 and hold the sealing cup 26 in sealing engagement with the interior wall of the casing. Compared to sealing cups typically used on well plungers and other tools, the sealing cup 26 used on the inventive tubing assembly 2 will preferably be sized and configured to operate on the basis of a relatively short longitudinal compression distance (preferably, e.g., about one-quarter inch) and will also preferably have a relatively high wall thickness (preferably, e.g., about one-half inch). In most cases, the length and resulting weight of the tubing assembly will provide more than enough compressive force to operate the thick-walled sealing cup. However, if needed, additional weight can be added to the tubing assembly 2 in any convenient manner such as, for example, increasing the length and/or thickness of the upper fishing neck 16 and/or increasing the tubing wall thickness or the length of the tapered end 18.

Alternatively, the sealing element could be held in place using a mechanical latch or other common latching mechanism.

The internal check valve 12 used in the inventive tubing assembly 2 will preferably be installed toward the upper portion of the tubing assembly 2 and will most preferably be installed above the sealing cup 26. The internal check valve 12 can be any type of device which will allow fluid to travel upwardly through the assembly but will prevent the recovered fluid from falling downwardly through the device. The internal check valve 12 is preferably a ball check valve comprising a floating ball 32 and a lower ball valve seat 34 which are retained within the lower end of the fishing neck 16 by the upper end of the body 20 of the sealing element assembly 4.

In an alternative embodiment (not shown) of the inventive tubing assembly for use, e.g., in deviated or horizontal wells, the inventive tubing assembly can include a plurality of internal check valves positioned at desired locations above the fluid intake openings 6.

Figure 2:
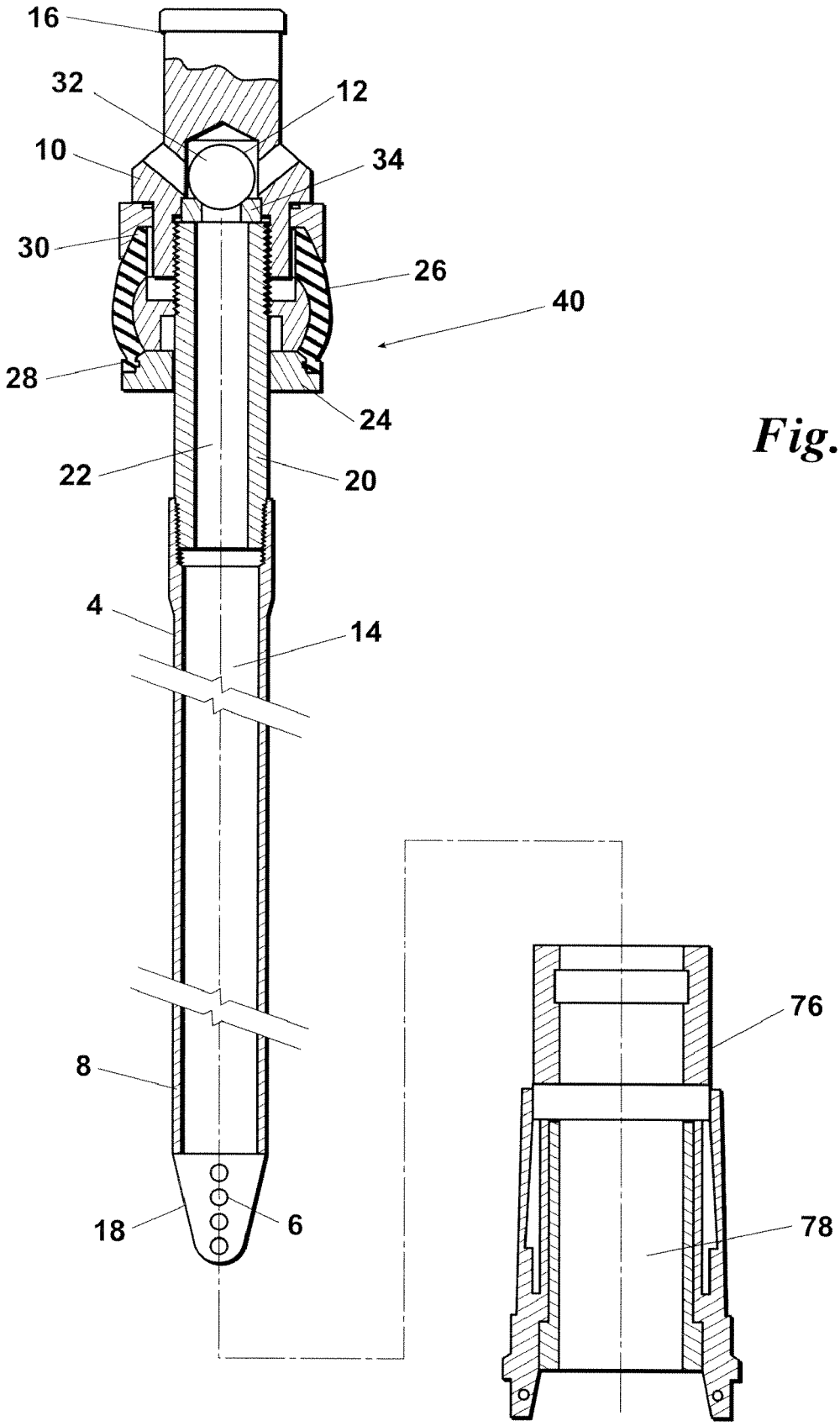
FIG. 2 is a cutaway elevational view of an alternative embodiment 40 of the inventive tubing assembly.

The inventive tubing assembly 2 shown in FIG. 1 also includes optional temperature and/or pressure sensing elements 36 and 38 contained, respectively, within the upper and lower ends of the tubing assembly 2. An alternative embodiment 40 of the inventive tubing assembly having no temperature and/or pressure sensing elements installed in the upper and lower ends thereof is shown in FIG. 2.

Figure 3:
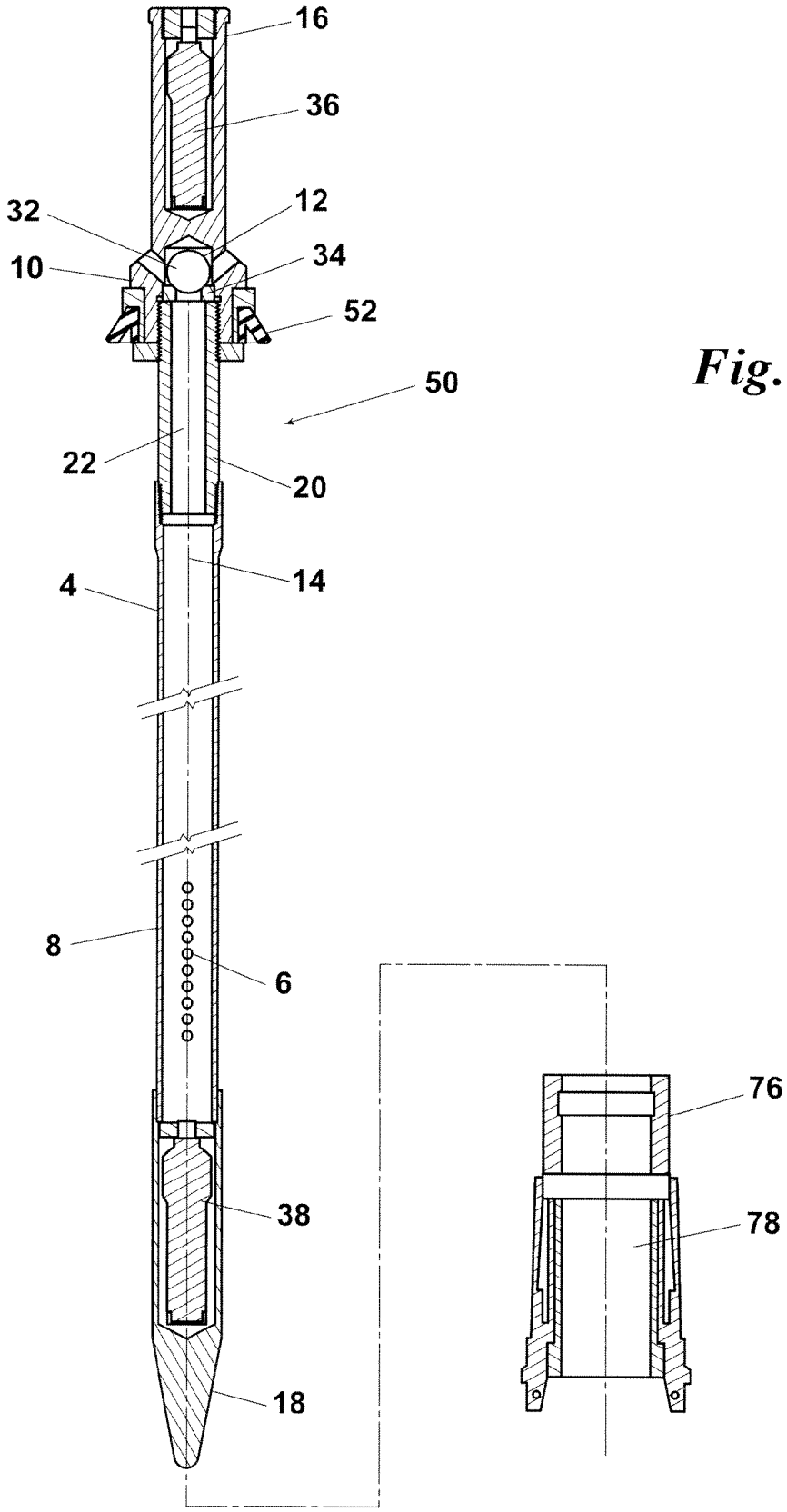
FIG. 3 is a cutaway elevational view of an alternative embodiment 50 of the inventive tubing assembly.

Another alternative embodiment 50 of the inventive tubing assembly is illustrated in FIG. 3. The inventive tubing assembly 50 is essentially identical to the inventive tubing assembly 2 except that the sealing element used in the inventive tubing assembly 50 is a V-cup 52 of a type commonly used in swabbing systems. The V-cup 52 will have an outside diameter which exceeds the inside diameter of the casing and will preferably be oriented downwardly as shown in FIG. 3 such that the gas pressure beneath the V-cup 52 will also act to hold the element in sealing engagement with the casing wall.

In yet another embodiment (not shown), the sealing element used in the inventive tubing assembly can be a common packer cup.

Figure 4:
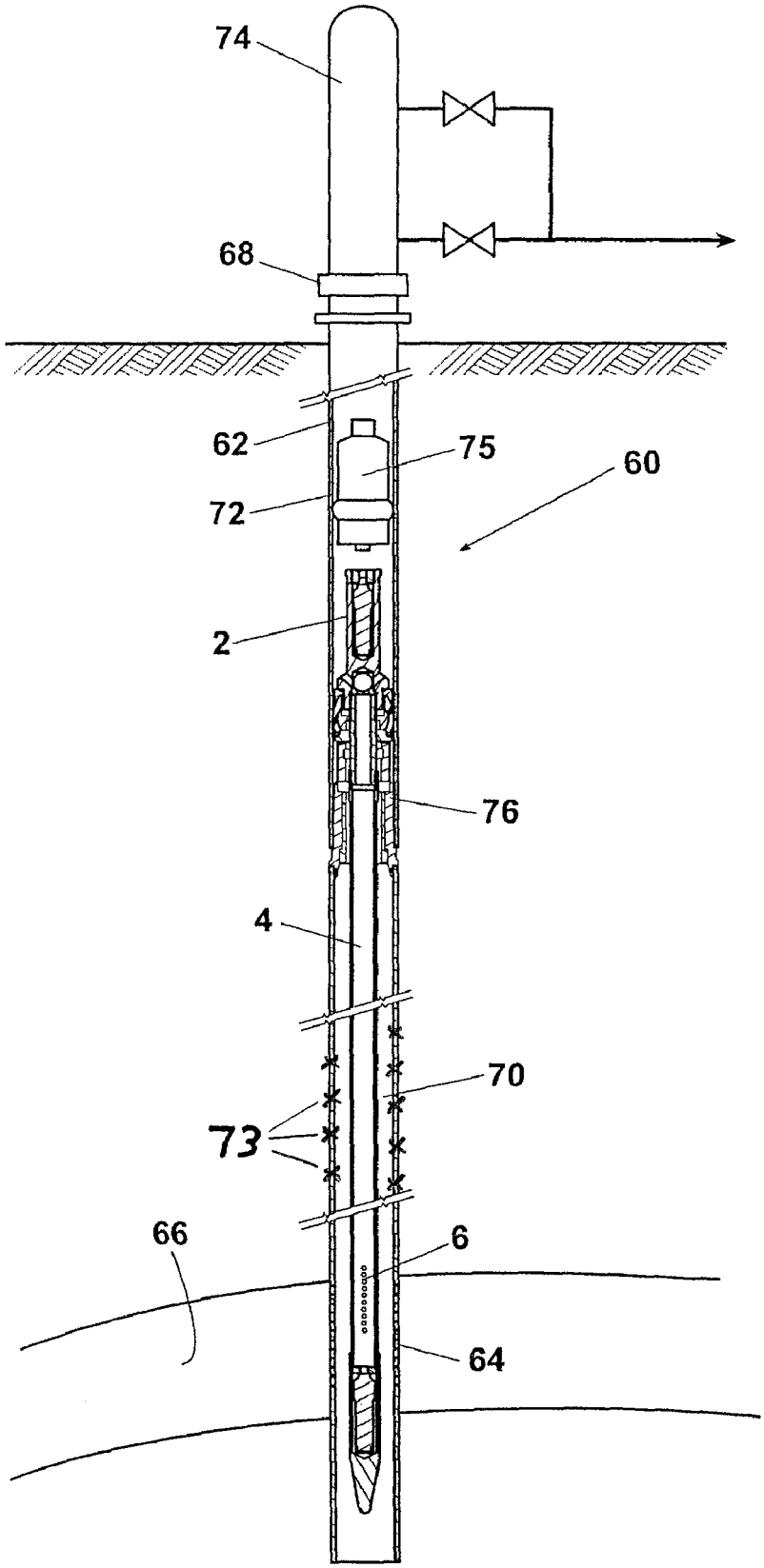
FIG. 4 is a partially cutaway elevational view of an inventive well assembly 60 comprising the inventive tubing assembly 2 installed in a well casing 62.

An apparatus and system 60 involving the installation and use of the inventive tubing assembly 2 in a well casing 62 is illustrated in FIG. 4. The well casing 62 comprises: a perforated lower casing region 64 positioned in a lower producing region 66 of the well 68; an intermediate casing region 70 which is located above the perforated lower casing region 64 and which will be traversed by the tubing string 4 of the inventive tubing assembly 2; and an upper casing region 72 (i.e., the casing region above the stop structure 76) which is located above the intermediate casing region 70 and which extends upwardly to the wellhead 74.

It will be understood that the intermediate casing region 70 can be a section of the well casing 70 which either begins at the upper end of the lower casing region 64 or begins at some other point spaced above the lower casing region 64. Similarly, the upper casing region 72 can comprise a section of the well casing 62 which either begins at the upper end of the intermediate casing region 70 or begins at a point spaced above the intermediate casing region 70. Also, although the well casing 62 in this embodiment is shown in FIG. 4 as including a lower section 64 which extends into the well producing region 66, it will be understood that the producing region can alternatively be an uncased zone (e.g., as in the case of an open hole completion) below the casing region 70.

It will also be understood that the intermediate casing region 70 illustrated in FIG. 4 can represent any type of section of the well casing 62 which is to be traversed by the tubing string 4 of the inventive assembly in order raise fluid from the lower well region 66 to the upper casing region 72 via the inventive tubing assembly 2. By way of example, but not by way of limitation, the casing region 70 could be (a) a perforated section of casing, (b) a section of casing which contains or forms an obstruction presenting an impediment to the use a plunger or other recovery device, or (c) some other elongate section of the well casing 62 which limits or prevents recovery in some way due to liquid loading or other conditions.

Examples of perforated regions 70 (i.e., regions with perforations 73) might include, but are not limited to: a length of perforated casing; a section of casing comprising a plurality of spaced apart perforated segments (e.g., for production from multiple formations at different depths), and (c) a damaged section of casing having one or more leaks formed therein. Examples of obstructions which might be present in or formed by a casing section 70 could include, but are not limited to: (a) a curved or other non-linear section of casing used in a deviated or horizontal well; (b) a tool or a portion thereof present in the well casing 62; (c) a casing liner; (d) a tapered or stepped section of casing wherein the inside diameter of the casing changes; (e) a rough section of casing which was formed by cementing or other operations and which cannot be smoothed sufficiently to prevent plunger damage;

and (f) a damaged section of casing having jagged edges or other detrimental features formed in the interior thereof.

To install the inventing tubing assembly 2 in the well casing 62, a stop structure 76 is first lowered into the casing 62 and secured at or above the top end of the intermediate casing region 70. The stop structure 72 can be any type of open or hollow stop structure having an interior passage 78 extending longitudinally therethrough for receiving the tubing string 4. The stop structure 76 will preferably be a wire set collar stop of a type commonly used in the art, but can alternatively be set by tubing or other means.

With the stop structure 76 secured in the well casing at the desired downhole location, the inventive tubing assembly 2 is then delivered down the well casing 62 by wire or other common means (e.g., tubing) such that the tubing string 4 is inserted through the longitudinal passage 78 of the stop structure 76. The operator continues to lower the tubing assembly into the well casing 62 until the landing collar or other contacting structure 24 of the tubing assembly 2 lands upon and is stopped by the upper end of the stop structure 76. As the landing collar 24 comes to rest on the upper end of the stop structure 76, the weight of the inventive tubing assembly 2 causes the landing collar 24 to slide upwardly on the sealing element assembly body 20 such that the sealing cup 26 is compressed and flexes outwardly to seal against the interior wall of the well casing 62. In addition, the length of the tubing string 4 will have been selected such that, once suspended in this manner, the fluid intake openings 6 provided in the lower end portion 8 of the tubing string will be positioned in the perforated lower region 64 or at any other desired region (e.g., above or below the perforated region 64).

When the inventive tubing assembly 2 is installed in the well casing 62 in this manner and the sealing element 26 is sealed against the interior wall of the casing, gas and liquid from the lower producing well region 66 will enter the fluid intake openings 6 and will rise through the inventive tubing assembly 2 from the lower casing section 64 to the lower end of the upper casing section 72. Once received in the upper casing region 72, the internal check valve 12 provided in the inventive tubing assembly 2 will prevent the recovered liquid from falling out of the upper casing region 72. Moreover, as also illustrated in FIG. 4, the liquid raised to the lower end portion of the upper casing region 72 can be removed and recovered by cycling a casing plunger 75 between the wellhead 74 and the bottom of the upper casing region 72 or by operating a swabbing device, a rod pump, gas lift, or other system in the upper casing region 72.

In an alternative embodiment of the inventive apparatus and system involving the use of the inventive assembly 2 in an open hole completion, the stop structure 76 can be set at the lower end of the well casing or can be set in the casing at any desired location above the lower end of the casing. In either case, the tubing string 4 will be of sufficient length to extend into the uncased lower region of the well such that the fluid intake openings 6 are located in, or in sufficient proximity to, a producing zone in the uncased region. The installed tubing assembly 2 will then operate to raise fluid from the uncased lower region of the well to the lower end of an upper casing section. The fluid received in the lower end of the upper casing section can then in turn be lifted to the wellhead by operating a plunger, swabbing device, rod pump, or other system in the upper casing section.

Although the inventive system and method are illustrated in FIG. 4 and described above as using the inventive tubing assembly 2, it will be understood that any other embodiment of the inventive tubing assembly shown and/or described herein could alternatively be used.

EXAMPLE

An inventive tubing assembly 2 of the type illustrated in FIGS. 1 and 4 was installed and tested in a gas well having a 4-½" I.D. casing therein. The casing included two perforated production zones. The upper perforated production zone was a 10 ft. zone running from a depth of 6,030 ft. to a depth of 6,040 ft. The lower perforated zone was a 4 ft. zone running from a depth of 6,342 ft. to a depth of 6,346 ft. Prior to the installation and use of the inventive assembly, the well was producing approximately 2,000 MCF of gas per month. A conventional plunger was operated above the upper perforated zone to remove liquid, primarily salt water, from the well. Prior to the installation and use of the inventive assembly, the back pressure gradient within the well acting upon the lower production zone was 0.2294 psi per foot.

The inventive tubing assembly 2 was installed in the well by first installing a hollow wire set collar stop 76 within the well casing at a depth just above the upper perforated zone. Next, the tubing assembly 2 was lowered into the casing such that the tubing string 4 was threaded through the collar stop 76. As the tubing assembly 2 was lowered, the assembly landing collar 24 landed upon the upper end of the collar stop 76 such that the weight of the tubing assembly 2 operated to compress the assembly sealing cup 26 into sealing engagement with the interior wall of the casing. The tubing assembly 2 was formed using 1-¼" diameter tubing and was about 360 ft. in length so that the fluid intake openings 6 in the lower end portion 8 of the suspended tubing string 4 were positioned in the lower perforated casing zone.

After the installation of the inventive apparatus, production from the well increased to about 2,500 MCF of gas per month based upon the same number of plunger cycles initiated per day in the upper section of the casing. Moreover, upon the installation of the inventive apparatus, the back pressure gradient acting against the lower production zone was desirably decreased to only 0.007 psi per foot.

* * * *

Thus, the present invention is well adapted to carry out the objectives and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within the spirit of this invention as defined by the claims.

What is claimed is:

1. A method of increasing a gas production rate from a well having a lower well region, said well having a casing therein comprising a perforated casing section located above said lower well region, said casing extending from a wellhead, and said method comprising the steps of:

(a) installing a tubing assembly in said well wherein said tubing assembly comprises a tubing string which is inserted downwardly into said well through a stop structure secured in said casing above said perforated casing section;

said tubing assembly further comprises a contacting structure which contacts said stop structure such that said tubing string is held suspended in said well and such that an upper section of said casing above said tubing assembly extends to said wellhead;

said tubing string has a lower portion which is positioned in said lower well region, said lower portion of said tubing string having one or more openings for receiving a gas from said lower well region such that said gas travels upwardly through said tubing assembly from said lower well region into a lower portion of said upper casing section;

said tubing string has an outside diameter, said upper section of said casing housing has an inside diameter, and said inside diameter of said upper section of said casing is larger than said outside diameter of said tubing string;

wherein a liquid is also received and accumulates in said lower portion of said upper section of said casing; and said tubing assembly also comprises at least one exterior seal which is positioned above said one or more openings and which seals between said tubing assembly and an interior wall of said casing to substantially prevent said liquid from flowing downwardly through said casing outside of said tubing assembly past said exterior seal;

(b) raising said liquid from said lower portion of said upper section of said casing to said wellhead using a lifting device which moves downwardly and upwardly in said upper section of said casing, said lifting device having at least one sealing element which contacts said interior wall of said casing as said lifting device moves upwardly in said upper section of said casing to raise said liquid; and (c) recovering said gas at said wellhead whereby said gas production rate from said well is increased.

2. The method of claim 1 wherein said tubing assembly further comprises an interior check valve positioned above said one or more openings such that said liquid received in said lower portion of said upper section of said casing is substantially prevented by said check valve from falling downwardly through said tubing assembly.

3. The method of claim 2 wherein said check valve is positioned within said tubing assembly above said contacting structure.

4. The method of claim 1 wherein said exterior seal of said tubing assembly is positioned above said stop structure.

5. The method of claim 1 wherein said lifting device used in step (b) to raise said liquid from said lower portion of said upper section of said casing to said wellhead is a casing plunger.

6. The method of claim 1 wherein said liquid is raised from said lower portion of said upper section of said casing to said wellhead by swabbing.

7. The method of claim 1 wherein said lifting device used in step (b) to raise said liquid from said lower portion of said upper section of said casing to said wellhead is a rod pump.

8. The method of claim 1 wherein said perforated casing section comprises a length of said casing having a plurality of perforations provided therein along said length.

9. The method of claim 1 wherein said perforated casing section comprises a plurality of spaced apart perforated segments of said casing, each said perforated segment having a plurality of perforations therein.

10. The method of claim 1 wherein said perforated casing section is a damaged section of said casing.

11. The method of claim 1 wherein said liquid comprises water.

* * * * *